US008872050B2

(12) United States Patent
Hierl et al.

(10) Patent No.: US 8,872,050 B2
(45) Date of Patent: Oct. 28, 2014

(54) CIRCUIT-BREAKER, IN PARTICULAR FOR LOW VOLTAGES

(75) Inventors: Andreas Hierl, Schmidgaden (DE); Siegfried Pirker, Ensdorf (DE)

(73) Assignee: Siemens Aktiengesellschaft, Munich (DE)

( * ) Notice: Subject to any disclaimer, the term of this patent is extended or adjusted under 35 U.S.C. 154(b) by 155 days.

(21) Appl. No.: 13/500,735

(22) PCT Filed: Oct. 6, 2010

(86) PCT No.: PCT/EP2010/064896

§ 371 (c)(1),
(2), (4) Date: Apr. 6, 2012

(87) PCT Pub. No.: WO2011/045214

PCT Pub. Date: Apr. 21, 2011

(65) Prior Publication Data

US 2012/0199453 A1 Aug. 9, 2012

(30) Foreign Application Priority Data

Oct. 15, 2009 (DE) ..... 10 2009 050 296

(51) Int. Cl.
*H01H 23/00* (2006.01)

(52) U.S. Cl.
USPC ..... 200/401; 200/244

(58) Field of Classification Search
USPC ..... 200/401, 400, 244, 304, 305, 250, 10; 218/244, 10
See application file for complete search history.

(56) References Cited

U.S. PATENT DOCUMENTS

| | | | | |
|---|---|---|---|---|
| 5,030,804 | A | 7/1991 | Abri | |
| 6,281,461 | B1 * | 8/2001 | Doughty | 218/154 |
| 6,639,168 | B1 * | 10/2003 | Castonguay et al. | 218/22 |
| 6,965,292 | B2 * | 11/2005 | Ciarcia et al. | 337/50 |
| 7,005,594 | B2 * | 2/2006 | Kim | 200/244 |

(Continued)

FOREIGN PATENT DOCUMENTS

| | | |
|---|---|---|
| CN | 100409391 C | 8/2008 |
| DE | 1540591 | 1/1970 |

(Continued)

OTHER PUBLICATIONS

German Priority Document for German Application No. 10 2009 050 296.3.

(Continued)

*Primary Examiner* — Renee S Luebke
*Assistant Examiner* — Harshad Patel
(74) *Attorney, Agent, or Firm* — Harness, Dickey & Pierce

(57) ABSTRACT

A circuit breaker is disclosed, in particular for low voltages, having a switch shaft and a contact lever rotationally mounted and extending transverse to the longitudinal axis of the switch shaft and protruding out of the switch shaft, the shaft carrying a movable contact on a side of the outer contour of the contact piece, and including a recess on the opposite side of the outer contour thereof for suspending a pin having a force applied thereto on both sides of the contact lever by way of one spring each, each applying a torque to the contact lever in the closing direction. The two springs each include a cover element extending along the spring and each disposed between the spring and the arc formed between the contact pieces when the circuit breaker is opened.

5 Claims, 4 Drawing Sheets

(56) References Cited

U.S. PATENT DOCUMENTS

| | | | | |
|---|---|---|---|---|
| 7,148,775 | B2 * | 12/2006 | Park | 335/16 |
| 7,977,592 | B2 * | 7/2011 | Shmukler et al. | 200/244 |
| 2005/0046539 | A1 | 3/2005 | Brignoni | |
| 2005/0231308 | A1 | 10/2005 | Kim | |
| 2006/0119455 | A1 | 6/2006 | Park | |
| 2009/0014417 | A1 | 1/2009 | Park | |
| 2009/0057112 | A1 | 3/2009 | Bennett et al. | |
| 2009/0065341 | A1 | 3/2009 | Ferree | |

FOREIGN PATENT DOCUMENTS

| | | | |
|---|---|---|---|
| DE | 1540591 | A1 | 1/1970 |
| DE | 19836754 | A1 | 2/2000 |
| DE | 19836754 | A1 | 2/2000 |
| DE | 102007040163 | A1 | 2/2009 |
| DE | 102007040163 | A1 | 2/2009 |
| DE | 102008007365 | A1 | 8/2009 |
| DE | 102008007365 | A1 | 8/2009 |
| EP | 0394922 | A1 | 10/1990 |
| EP | 0394922 | A1 | 10/1990 |
| JP | 200921243 | A | 1/2009 |
| JP | 2009021243 | A | 1/2009 |

OTHER PUBLICATIONS

International Search Report.

* cited by examiner

CIRCUIT-BREAKER, IN PARTICULAR FOR LOW VOLTAGES

PRIORITY STATEMENT

This application is the national phase under 35 U.S.C. §371 of PCT International Application No. PCT/EP2010/064896 which has an International filing date of Oct. 6, 2010, which designated the United States of America, and which claims priority to German patent application number DE 10 2009 050 296.3 filed Oct. 15, 2009, the entire contents of each of which are hereby incorporated herein by reference.

FIELD

At least one embodiment of the invention generally relates to a circuit breaker, in particular for low voltages.

BACKGROUND

Circuit breakers for low voltages are generally known and have a movable and a fixed contact for opening and closing, which have contact pieces facing each other. The contact pieces are arranged on the free end of a contact lever, which is rotationally mounted on or in a switch shaft. The contact lever extends transversely to the longitudinal axis of the switch shaft and protrudes from the switch shaft with its free end. On the same side of the rotational axle opposite the contact piece in the outer contour of the contact lever is located a recess for suspension of a pin, which is aligned parallel to the switch shaft. Springs engage on both ends of the pin, which apply a torque to the contact lever in the closing direction. In the case of a closed circuit breaker the contact pieces of the two contacts are pressed against each other by means of the spring force. The contact lever is generally embodied as a double lever. Leaf and wound wire springs are used as springs. These can be embodied as tension, compression or torsional springs.

In the event of a short circuit the contacts open after the exceeding of a prescribed current threshold. An electric arc here occurs between the contact pieces. This has the desirable property that it limits the current. The plasma and hot gas generated by the electric arc, whose temperature is far higher than 1000 degrees Celsius, has the disadvantage that it can damage parts of the rotor. In the case of compact circuit breakers this relates in particular to the springs, in light of its small structural volume.

In order to compensate for deformation of the springs, they are, for example overdimensioned, as a result of which due to their greater mass they have a greater resistance to heat. This again however leads to a greater installation volume in the rotor-housing, and a stronger actuation mechanism is required. It is also known to route the springs outwards by means of deflection parts and to shield them there by way of a cover. The number of individual parts of the circuit breaker and the assembly effort are, however, increased thereby. It is also known to cover the rotor body with the springs radially by means of a cylinder.

SUMMARY

At least one embodiment of the invention permits the function of the circuit breaker by way of a cover which is of simple design and is simple to assemble.

The subclaims represent advantageous embodiments.

At least one embodiment provides that the two springs each have a cover element resting on the pin, which extends along the spring and is arranged in each case between spring and the electric arc (in the case of opening contacts), which is formed in each case between den contact pieces, when the circuit breaker is opened.

BRIEF DESCRIPTION OF THE DRAWINGS

Embodiments of the invention is described in greater detail below on the basis of the drawings, in which.

DETAILED DESCRIPTION OF THE EXAMPLE EMBODIMENTS

A structurally simple embodiment provides for the two cover elements to be connected to each other via a transverse element. Fixing of the two cover elements is simplified if the two cover elements rest on the pin over the transverse element. In order to simplify assembly, it is proposed that the transverse element is clamped onto the pin.

Technical simplicity is achieved if the two cover elements are embodied as plastic parts or metal plates.

The robustness of the switch in increased if the contact lever is embodied as a double lever.

Figure 1:
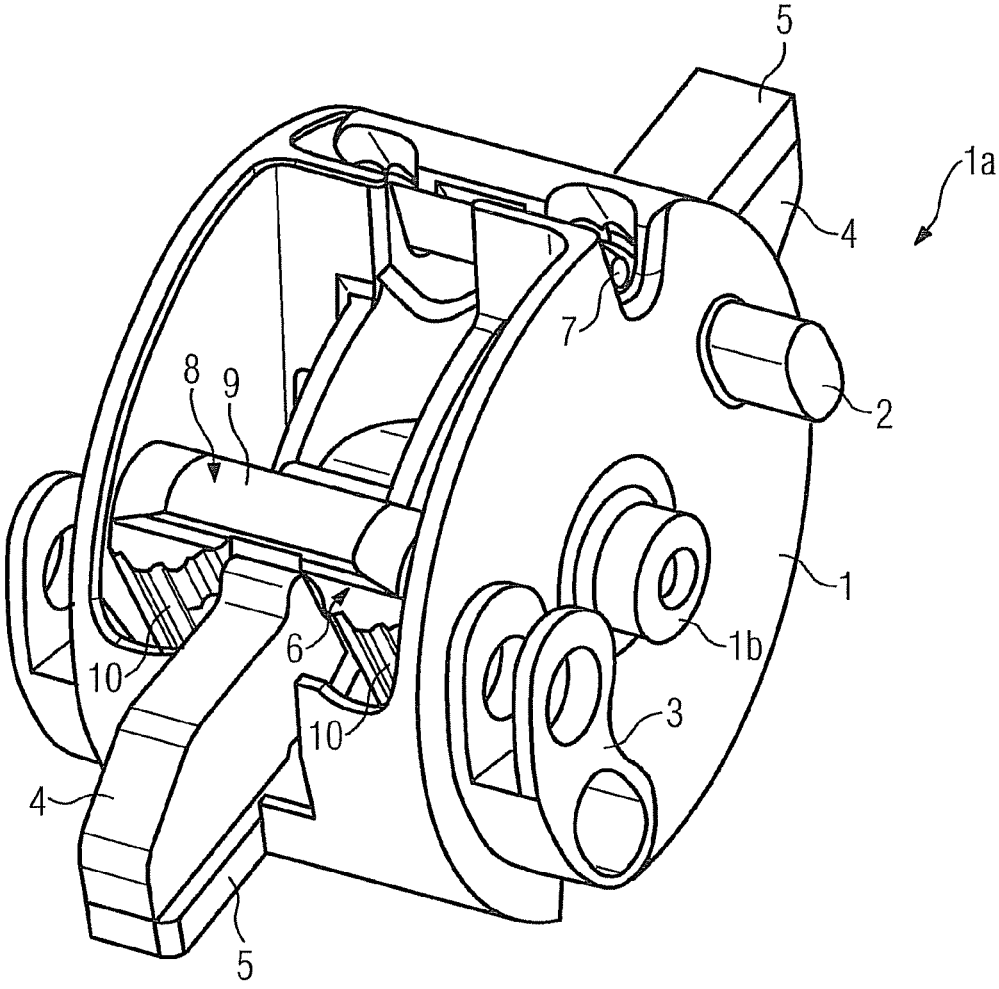
FIG. 1 shows a switch shaft segment of a switch shaft of a circuit breaker.
Figure 2:
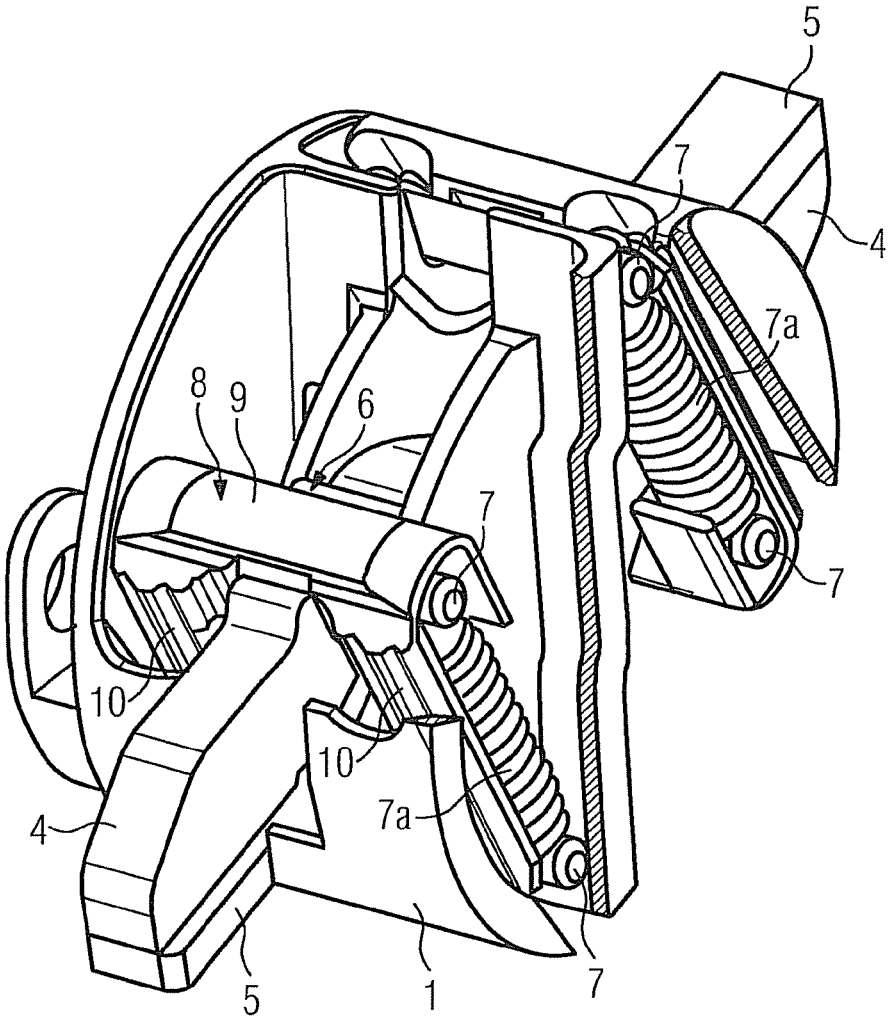
FIG. 2 shows the switch shaft segment according to FIG. 1 with the housing represented in cutaway from, FIG. 3 shows the cover of the switch shaft segment with transverse element and the two cover elements according to FIG. 1.

FIGS. 1 and 2 show a switch shaft segment 1 of a switch shaft 1*a* of a circuit breaker for low voltages (not shown in more detail), wherein its housing is represented in cutaway form in FIG. 2. The switch shaft 1*a* with its rotational axle 1*b* is here formed from a multiplicity of switch shaft segments 1 connected laterally with each other. Connecting elements 2, 3 serve this purpose.

A contact lever 4 is rotationally mounted in the switch shaft segment 1, which is embodied as a double lever and which extends transversely to the rotational axle of the switch shaft segment 1 (of the switch shaft 1*a*). The two ends of the contact lever 4 protrude on two sides from the switch shaft segment 1. On their ends they in each case carry a contact piece 5 on one side of the outer contour, which face away from each other and form the movable contact of the circuit breakers. The contact lever 4 in FIG. 1 is shown in its ON-position, in which the two contact pieces 5 abut oppositely disposed fixed contact pieces (not shown), which form the fixed contact.

A recess 6 is in each case provided on the side of the outer contour of the contact lever 4 lying opposite the contact piece 5, into which is introduced a pin 7 running parallel to the rotational axle of the switch shaft segment 1. Springs 7*a* engage the pin 7 at both ends, which apply a torque to the contact lever 4 in the closing direction. The other end of the spring 7*a* is fixed to the housing of the switch shaft segment 1 via pin 7.

A cover 8 here embodied in one piece is fixed to the pin 7 by means of a transverse element 9, which to this end is mounted (clamped) on the pin 7. Cover elements 10 which run downwards in relation to FIG. 1 in the form of plastic parts or metal plates for covering the springs 7*a* are arranged on the transverse element 9 at both ends. The cover elements 10 are here located in each case between a spring 7*a* and the associated contact pieces 5 or contacts, between which the electric arc forms in each case in the event of a short circuit and opening contacts.

Figure 3:
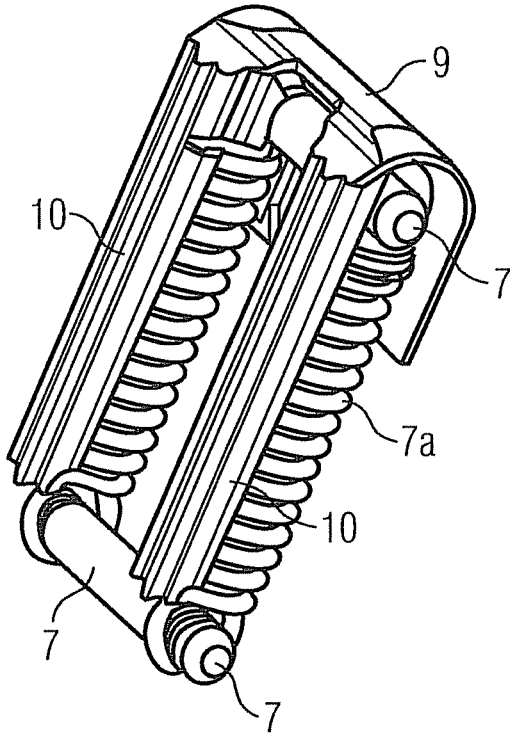

FIG. 3 shows the cover 8 with the transverse element 9 and the two cover elements 10 and the pin 7 with the springs 25 7*a* on its own.

Figure 4:
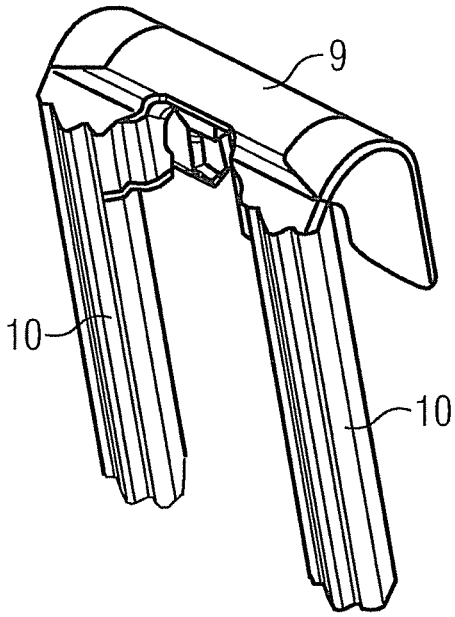
FIG. 4 shows the cover according to FIG. 3 in a spatial representation.
Figure 5:
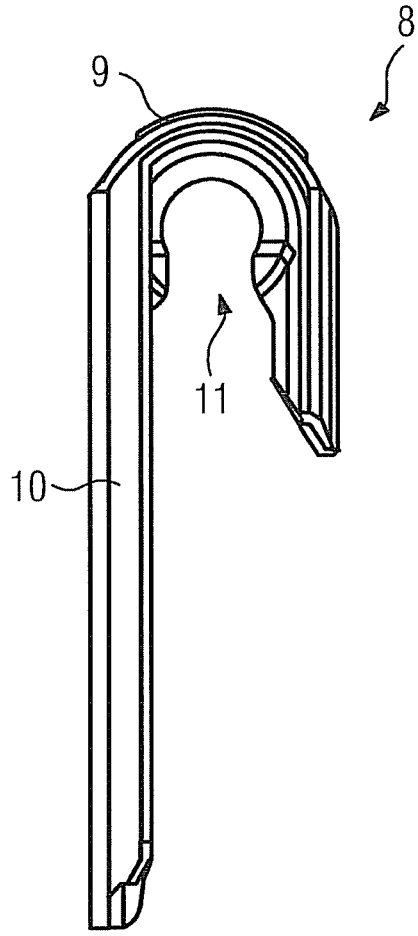
FIG. 5 shows the cover according to FIG. 3 in a side view.

FIG. 4 shows the cover 8 in a spatial representation; its side view can be seen in FIG. 5. A tapering 11 of the transverse element 9 (see FIG. 5) ensures firm clamping upon the cover 8 being mounted on the pin 7.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A circuit breaker, comprising:

a movable contact and a fixed contact configured to open and close contact pieces of the movable and fixed contacts facing each other;

a switch shaft; and a contact lever, rotationally mounted on or in the switch shaft and extending transversely to a longitudinal axis of the switch shaft, a free end of the contact lever, protruding from the switch shaft, carrying on one side of its outer contour the contact piece of the movable contact, and a same side of the rotational axle and an opposite side of the outer contour including a recess for suspension of a pin extending parallel to the switch shaft, each side of the contact lever including a spring configured to apply a force to the pin, each of the two springs applying a torque to the contact lever in a closing direction, each of the two springs including a cover element, each cover element extending along the respective spring and each cover element being arranged between a corresponding one of the two springs and an electric arc formed between the contact pieces, when the circuit breaker is opened, the cover elements of the two springs being connected to each other via a transverse element, the transverse element being clamped on the pin.

2. The circuit breaker, of claim 1, wherein the two cover elements rest on the pin over a transverse element.

3. The circuit breaker, of claim 1, wherein the two cover elements are embodied as plastic parts or metal plates.

4. The circuit breaker of claim 1, wherein the contact lever is embodied as a double lever.

5. The circuit breaker of claim 1, wherein the circuit breaker is a circuit breaker for low voltages.

* * * * *